US006877782B2

(12) United States Patent
Magnusson

(10) Patent No.: US 6,877,782 B2
(45) Date of Patent: Apr. 12, 2005

(54) ADJUSTABLE SLIDING BOLT FOR A LOCK

(75) Inventor: Claes Magnusson, London (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/303,031

(22) Filed: Nov. 25, 2002

(65) Prior Publication Data

US 2004/0100104 A1 May 27, 2004

(51) Int. Cl.[7] ..... E05C 1/12
(52) U.S. Cl. ..... 292/170; 292/DIG. 31
(58) Field of Search ..... 292/165, 167, 292/170, 169, 173, DIG. 60, DIG. 73, DIG. 31

(56) References Cited

U.S. PATENT DOCUMENTS 2,121,596 A * 6/1938 Hill ..... 220/57
3,860,276 A * 1/1975 Lambrecht ..... 292/169
4,060,267 A * 11/1977 Monfardini ..... 292/173
4,632,438 A * 12/1986 Mckinney ..... 292/87
4,662,666 A * 5/1987 Wimmer ..... 292/337
4,852,918 A * 8/1989 Allen ..... 292/169
4,880,261 A * 11/1989 Bisbing ..... 292/7

* cited by examiner

*Primary Examiner*—Gary Estremsky
(74) *Attorney, Agent, or Firm*—Paul & Paul

(57) ABSTRACT

An adjustable sliding bolt (16) for a lock, comprising a first part (17) guided for reciprocating sliding movement along a first plane relative to a housing (11) of the lock, and a second part (23) operatively connected to the first part and having a first and a second end. The second end has an abutment surface (24) located in a second plane substantially parallel to the first plane. The second part (23) is integral with the first part (17) and hingedly connected thereto at its first end by a reduced material thickness portion (26). An adjustment screw (32) is provided between the first part and the second part at a distance from its first end. The screw is operative to positively move the second end and the abutment surface (24) two opposite directions perpendicular to the first and second planes.

19 Claims, 3 Drawing Sheets

Fig. 1
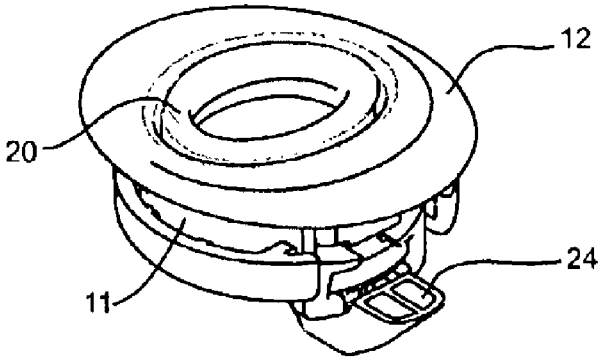
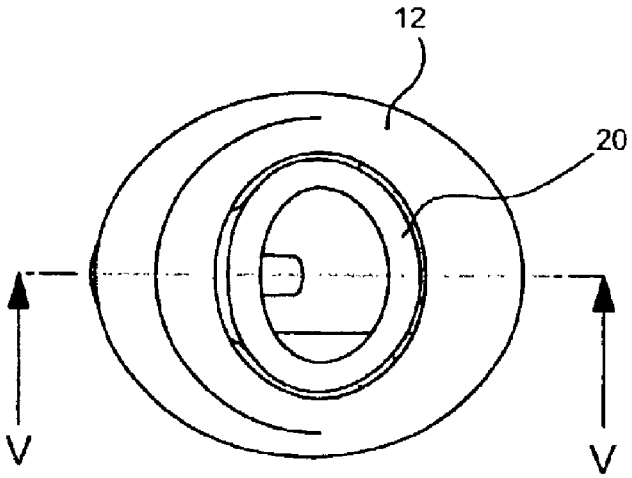
Fig. 2
Fig. 3
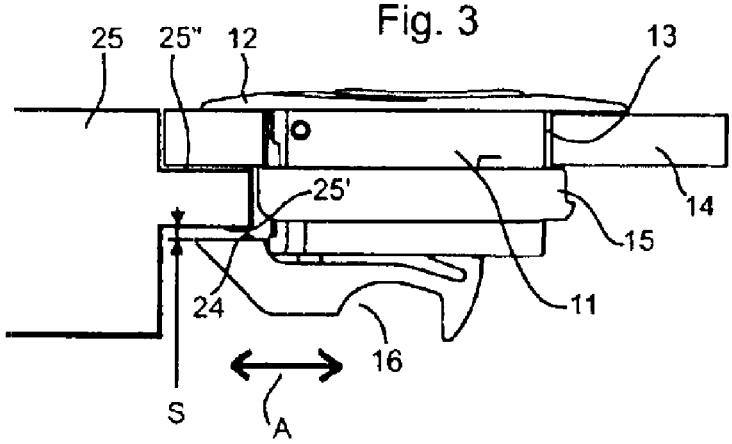

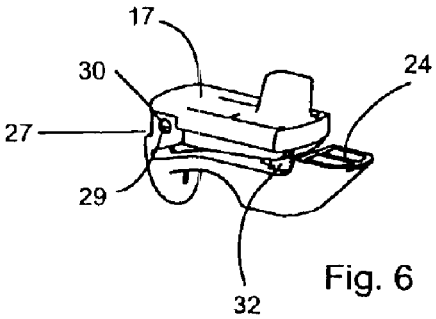
Fig. 6
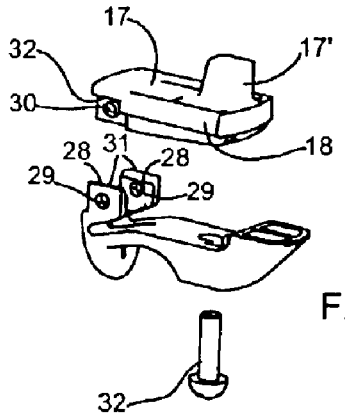
Fig. 7
Fig. 8
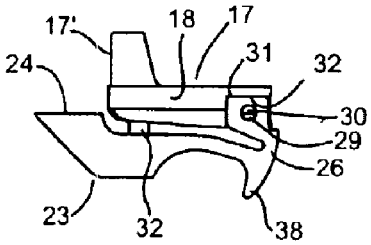
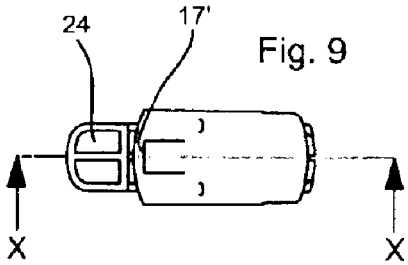
Fig. 9
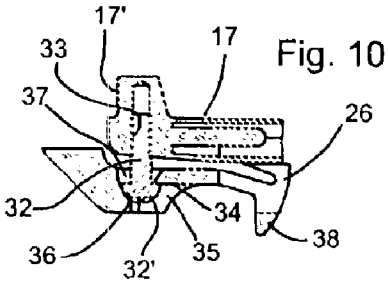
Fig. 10
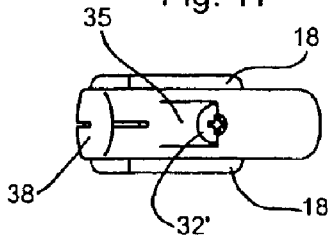
Fig. 11

ADJUSTABLE SLIDING BOLT FOR A LOCK

The present invention concerns an adjustable sliding bolt for a lock.

BACKGROUND OF THE INVENTION

When a lock is mounted in a door, a hatch or the like, it is a desire that the abutment surface of its locking bolt, when in its locking position, shall be as close as possible to a counter-surface associated to, e.g., a door post or the like. Evidently, this is because an increased spacing between the abutment surface and the counter-surface allows a certain degree of movement of the door, and, thus, possible noise due to such movement.

SUMMARY OF THE INVENTION

The present invention has as its object to provide a solution to that problem by providing a sliding bolt for a lock enabling adjustment of its abutment surface in relation to stationary parts of a lock and, thereby, a door or the like wherein the lock is mounted.

The adjustable sliding bolt for a lock according to the present invention comprises a first part guided for reciprocating sliding movement along a first plane relative to a housing of the lock, and a second part operatively connected to the first part and having a first and a second end. The second end has an abutment surface located in a second plane substantially parallel to said first plane. The second part is integral with the first part and hingedly connected thereto at said first end by a reduced material thickness portion. An adjustment means is provided between the first part and the second part at a distance from said first end. The adjustment means, preferably being a screw, is operative to positively move said second end and said abutment surface in opposite directions substantially perpendicular to said first and second planes.

BRIEF DESCRIPTION OF THE DRAWINGS

An embodiment of the present invention will be described hereinafter, reference being made to the accompanying drawings, wherein:

FIG. 1 is a perspective view of a lock having an adjustable sliding bolt according to the present invention, FIG. 2 is a top view of the lock;

FIG. 3 is a side view of the lock 1 shown to be mounted in a door leaf;

FIG. 6 is a perspective view of the lock bolt used in the lock of FIG. 1;

FIG. 7 is a perspective view corresponding to that according to FIG. 5, but showing the lock bolt an a disassembled state;

FIG. 8 is a side view of the lock bolt according to FIG. 6;

FIG. 9 is a top view of the lock bolt;

FIG. 10 is a section taken along line X—X in FIG. 9; and

FIG. 11 is a bottom view of the lock bolt.

Figure 4:
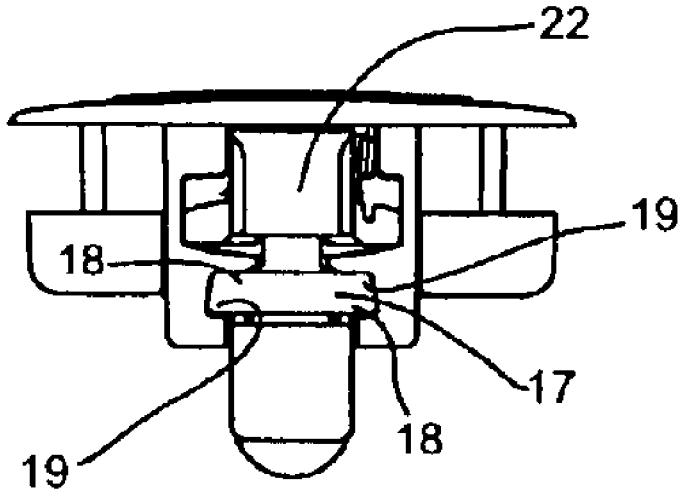
FIG. 4 is an end view of the lock.

The invention will be described first with reference to FIGS. 1–4 showing a lock 10 utilizing a lock bolt according to the present invention.

The lock includes a housing 11 having a rim 12. When the lock is mounted in an aperture 13 in a door leaf 14, the rim abuts one side of the door leaf, whereas another part 15 of the housing abuts the opposite side of the door leaf, thus keeping the lock steady in position.

Figure 5:
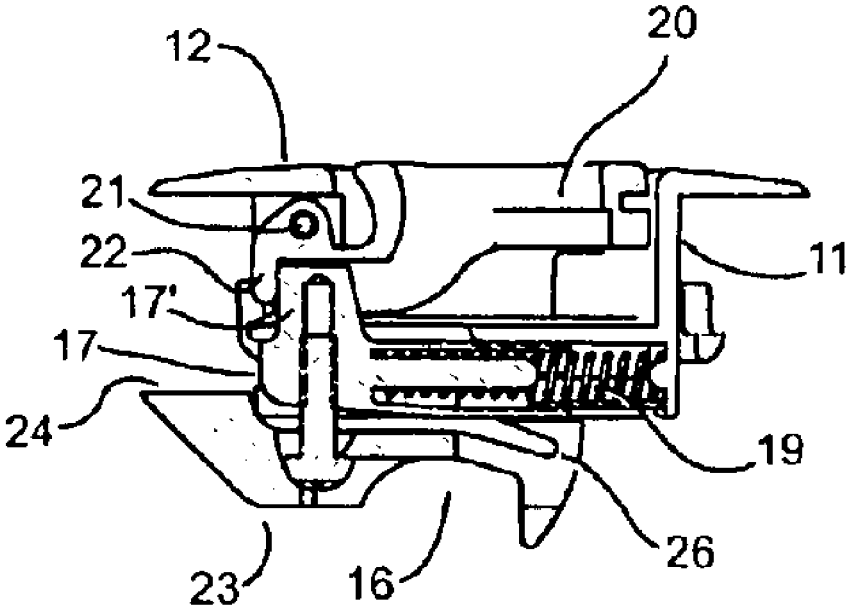
FIG. 5 is a section through the lock according to FIG. 1 taken along line V—V in FIG. 2.

The lock 10 is provided with a sliding lock bolt 16 according to the present invention. It includes a first part 17 slidably guided relative to the housing 11 so as to enable movement in two opposite directions indicated by an arrow A in FIG. 3. More precisely, the first part 17 has lateral ribs 18 received within corresponding recesses 18 in the housing 11 extending in the directions of movement. A helical spring 19 (FIG. 5) abutting with one of its ends the housing 11 and with its other end the first part 17, urges the first part to the left in FIGS. 3 and 5, i.e., towards the locking position of the lock bolt 16. Movement of the first part in the opposite, opening direction is achieved by means of a handle lever 20 hingedly connected to the housing at 21 and having a projection 22 abutting a neck 17' of the first part 17.

The lock bolt 16 also includes a second part 23 operatively connected to the first part 17 so as to move with it in its reciprocating movement. The second part has an abutment surface 24 which, in the locking position of the lock shown in FIG. 3, provides locking of the door leaf 14 by abutting a counter-surface 25' of a door post 25 in the closed position of the door leaf. In the closed position of the door leaf, it normally also abuts a surface 25" of the door post 25 opposite to the counter-surface 25'.

Due to tolerances, manufacturing imperfections or any other reason, there is often a space S (FIG. 3) between the counter-surface 25' and the abutment surface 24. Under certain circumstances, such as vibrations, such space may cause a disturbing noise, and it is a desire to keep the space as small as possible. It may also occur that, due to, e.g., varying thickness of the door leaf, there is a need to adjust the position of the abutment surface 24, i.e. to move it in either direction perpendicularly to its plane.

The adjustable lock bolt of the present invention provides easy adjustment of the position of its abutment surface as will be described hereinafter with particular reference to FIGS. 6–11.

As appears particularly from FIG. 8, the first part 17 and the second part 23 of the lock bolt are interconnected at one end of the second part. More precisely, this is achieved by a reduced material thickness portion 26 formed integrally with a portion 27 of the first part 17. This portion 27 is functionally a portion of the first part 17 and could be integral therewith, but, for manufacturing reasons, it is preferred to make it as a separate part rigidly joined to the main portion of the first part. This is shown to be effected by means of two spaced ears 28 having a respective aperture 29 that may be snapped onto a respective protruding boss 30 integrally formed on the first part 17. Straight edges 31 of the ears 28 engage corresponding undercut portions 32 of the first part 17.

The reduced thickness portion 26 functions as a hinge and allows a certain degree of relative swinging movement between the first part 17 and the second part 23. In order to control such movement and to positively adjust the position of the abutment surface 24, a screw 32 is threadedly engaged in an internally threaded hole 33 in the first part 17. The screw head 32' simultaneously abuts the second part 23 in both its directions of displacement by engaging with its underside a portion 34 of a recess 35 formed in the second part, and with its exterior an undercut portion 36 thereof. The stem 32" of the screw extends through an opening 37 in the second part 23.

It has been found sufficient for most applications to allow a stroke of 63 mm about an intermediate position, i.e., totally 6 mm. Since such relatively short stroke does not involve any noticeable or significant deviation from a parallel move of the abutment surface 24, its movement In order to facilitate introduction of the screw in the recess 35, its undercut portion 36 is substantially part-spherical, and the exterior of the screw head 32' is correspondingly shaped.

From the bolt side of the lock 10, the bolt may be operated to open the lock by engaging a knob portion 38 of the second part 17.

What is claimed is:

1. An adjustable sliding bolt for a lock having a housing, said adjustable sliding bolt comprising a first part guided for reciprocating sliding movement along a first plane relative to the housing of the lock, and a second part operatively connected to said first part and having a first and second end, said second end having an abutment surface located in a second plane substantially parallel to said first plane, wherein said second part is integral with said first part and hingedly connected thereto at said first end by a reduced material thickness portion, and wherein an adjustment means is provided between said first part and said second part at a distance from said first end, said adjustment means being operative to positively move said abutment surface in two opposite directions substantially perpendicular to said first and second planes.

2. An adjustable sliding bolt for a lock having a housing, the adjustable sliding bolt comprising a first part guided for reciprocating sliding movement along a first plane relative to the housing of the lock and a second part operatively connected to said first part and having a first end and a second end, said second end having an abutment surface located in a second plane substantially parallel to said first plane wherein said second part is integral with said first part and hingedly connected thereto at said first end by a reduced material thickness portion, and wherein an adjustment means is provided between said first part and said second part at a distance from said first end, said adjustment means being operative to positively move said abutment surface in two opposite directions substantially perpendicular to said first and second planes, wherein said adjustment means is a screw having one end threadedly engaging one of said first and second parts, and having an opposite end positively engaging said second part to exert forces thereon in said opposite directions.

3. The adjustable sliding bolt according to claim 2, wherein said opposite end of the screw is a screw head having a substantially part-spherical exterior surface engaging a correspondingly shaped surface of said second part.

4. A lock comprising a housing and an adjustable sliding bolt, the adjustable sliding bolt comprising a first part guided for reciprocating sliding movement along a first plane relative to the housing of the lock, and a second part operatively connected to said first part and having a first and second end, said second end having an abutment surface located in a second plane substantially parallel to said first plane, wherein said second part is integral with said first part and hingedly connected thereto at said first end by a reduced material thickness portion, and wherein an adjustment means is provided between said first part and said second part at a distance from said first end, said adjustment means being operative to positively move said abutment surface in two opposite directions substantially perpendicular to said first and second planes.

5. A lock according to claim 4, further including a helical spring abutting with one of its ends the housing and with its other end the first part, the helical spring urging the first part towards the locking position of the lock bolt.

6. A lock according to claim 4, wherein movement of said abutment surface in opposite directions is achieved by means of a handle lever hingedly connected to the housing and having a projection abutting a neck of the first part.

7. A lock according to claim 6, wherein the abutment surface provides locking of a door leaf by abutting a counter surface of a door post in the closed position of the door leaf.

8. A lock according to claim 4, wherein the reduced material thickness portion is formed from a separate part rigidly joined to the main portion of the first part by two spaced ears having respective apertures that are snapped onto a respective protruding boss integrally formed on the first part.

9. A lock according to claim 8, wherein straight edges of the spaced ears engage corresponding undercut portions of the first part.

10. A lock according to claim 8, wherein the reduced thickness portion functions as a hinge and allows a degree of relative swinging movement between the first part and the second part.

11. A lock according to claim 4, wherein a screw head abuts the second part in both directions of displacement by engaging with its underside a portion of a recess formed in the second part and with its exterior an undercut portion thereof.

12. A lock according to claim 11, wherein a stem of the screw extends through an opening in the second part.

13. A lock according to claim 4, wherein the bolt is operated to open the lock by engaging a knob of the second part from the bolt side of the lock.

14. A lock according to claim 4, the housing having recesses extending in the direction of movement of the sliding bolt, the first part having lateral ribs received within the corresponding recesses in the housing.

15. An adjustable sliding bolt for a lock, the lock having a housing having recesses extending in the direction of movement of the sliding bolt, the adjustable sliding bolt comprising a first part guided for reciprocating sliding movement along a first plane relative to the housing of the lock so as to enable movement in two opposite directions, the first part having lateral ribs received within the corresponding recesses in the housing, and a second part operatively connected to said first part and having a first and second end, said second end having an abutment surface located in a second plane substantially parallel to said first plane, wherein said second part is integral with said first part and hingedly connected thereto at said first end by a reduced material thickness portion, and wherein an adjustment means is provided between said first part and said second part at a distance from said first end, said adjustment means being operative to positively move said abutment surface in two opposite directions substantially perpendicular to said first and second planes.

16. An adjustable sliding bolt according to claim 15, further including a helical spring abutting with one of its ends the housing and with its other end the first part, the helical spring urging the first part towards the locking position of the lock bolt.

17. An adjustable sliding bolt according to claim 15, wherein movement of the first part and the opposite directions is achieved by means of a handle lever hingedly connected to the housing and having a projection abutting a neck of the first part.

18. An adjustable sliding bolt according to claim 15, wherein the abutment surface provides locking of a door leaf by abutting a counter surface of a door post in the closed position of the door leaf.

19. An adjustable sliding bolt according to claim 15, wherein the reduced material thickness portion is formed from a separate part rigidly joined to the main portion of the first part by two spaced ears having respective apertures that are snapped onto a respective protruding boss integrally formed on the first part.

* * * * *